US006513785B1

(12) United States Patent
Worley

(10) Patent No.: US 6,513,785 B1
(45) Date of Patent: Feb. 4, 2003

(54) CONCRETE DECK FORMING APPARATUS AND METHOD

(75) Inventor: Ross W. Worley, Kansas City, MO (US)

(73) Assignee: Wall-Ties & Forms, Inc., Shawnee, KS (US)

( * ) Notice: Subject to any disclaimer, the term of this patent is extended or adjusted under 35 U.S.C. 154(b) by 0 days.

(21) Appl. No.: 09/649,523

(22) Filed: Aug. 28, 2000

(51) Int. Cl.[7] ..... E04G 11/00
(52) U.S. Cl. ..... 249/18; 249/210; 52/126.6
(58) Field of Search ..... 52/126.6; 249/18, 249/28, 210

(56) References Cited

U.S. PATENT DOCUMENTS 1,907,877 A * 5/1933 Roos ..... 249/28 X
3,059,738 A * 10/1962 Lutz ..... 249/210 X
3,397,858 A * 8/1968 Williams ..... 249/18
3,409,266 A * 11/1968 Jennings ..... 249/18
3,430,910 A * 3/1969 Bowden et al. ..... 249/210 X
5,643,487 A * 7/1997 Malone ..... 249/18
6,176,463 B1 * 1/2001 Rock ..... 249/18

FOREIGN PATENT DOCUMENTS

CA 1166867 * 5/1984 ..... 249/18
GB 1250875 * 10/1971 ..... 249/18

* cited by examiner

*Primary Examiner*—Carl D. Friedman
*Assistant Examiner*—Naoko Slack
(74) *Attorney, Agent, or Firm*—Shook, Hardy & Bacon L.L.P.

(57) ABSTRACT

A deck forming system is utilized for forming and supporting concrete decks. The deck forming system includes deck panels extending between deck beams which are supported by a jack post assembly. Flat bars are used to join the deck beams to a header supported by a jack post in the jack post assembly. Fasteners such as pins and wedges removably secure the flat bars to the ends of the deck beams and the header so that the deck beams can be removed while the jack post and header remain in place to support the poured concrete deck until it reaches a predetermined strength.

10 Claims, 3 Drawing Sheets

CONCRETE DECK FORMING APPARATUS AND METHOD

BACKGROUND OF THE INVENTION

This invention is directed generally to methods and apparatus useful in pouring of concrete decks and, more particularly, to the methods and apparatus for forming and supporting poured concrete decks.

When pouring a concrete deck that is spaced above an underlying floor, such as in multi-level buildings or concrete houses, a deck forming system must be erected to form and support the poured concrete until it has cured to a preselected strength. A typical deck forming system uses a grid formed from interconnected deck beams that are supported at the desired height by a plurality of spaced apart and vertically adjustable jack posts. The open areas in the grid are completely filled by a plurality of appropriately sized flat panels that extend horizontally between the deck beams. The deck panels are removably secured to the deck beams by suitable fasteners. One commonly used fastener utilizes a pin that extends through aligned holes in the ends of the panels and sides of the beams and is retained in place by a wedge that extends through a closed-end slot in the pin. The resulting deck forming system provides an uninterrupted, horizontal, upper surface onto which the concrete is poured to form the deck.

After pouring concrete decks, it is normally necessary to leave the jack posts in place for an extended period of time to support the concrete deck while the concrete achieves the strength necessary to span the distance between the supporting walls. Jack post support is particularly needed when the deck must also support the load of one or more overlying decks that are being sequentially formed and poured. Although the jack posts must normally be left in place for an extended period of time, the deck panels and beams can be removed more quickly and it is often desirable to remove these components as soon as possible so that they can be used to form other concrete decks. In order to facilitate removal of these components while leaving the jack post in place, it is known to use a drop head assembly to removably connect the jack post to the grid beams. These drop heads use a header having a flat upper surface which serves as a partial form for the concrete deck and a cross member that is carried on a second screw on the jack post. The cross member can support up to four deck beams and has upstanding retaining pins that are received in complementally positioned holes formed in the beams. The cross member can be vertically adjusted by turning the second screw to bring the top surface of the beams in horizontal alignment with the top surface of the header during erection of the grid. After the deck has been poured and has sufficiently hardened, the cross member can be lowered by turning the second screw in the opposite direction to provide sufficient vertical clearance to allow removal of the deck panels and to permit the deck beams to be lifted off the cross member. The header remains in place supporting the concrete deck and can be removed with the jack post by turning the first screw to shorten the height of the jack post.

While the drop head assembly described above allows the deck panels and grid beams to be "stripped" or removed while the jack post remains in place, erection of the grid can be cumbersome and time-consuming because of the need to adjust the height of the jack screw using the first screw followed by adjusting the second screw to raise the cross member and beams to the desired height. Removal of the grid is also time-consuming because the cross member must first be lowered sufficiently to provide the vertical clearance needed to lift the beams off of the retaining pins carried by the cross member. The use of the cross member and the attendant need for a second screw also increases the cost and weight of the drop head assembly.

A need has thus developed for a lighter and less expensive jack post assembly that allows the deck forming grid to be more easily and quickly erected and disassembled.

SUMMARY OF THE INVENTION

In one aspect, the present invention is directed to an apparatus for use in forming and supporting a poured concrete deck. The apparatus comprises: a header having opposed ends and a center support which carries a generally flat first forming plate at an upper end thereof, the header further comprising downwardly extending first mounting brackets positioned at opposite sides of the forming plate for releaseably holding deck panels on which the concrete deck is poured; at least one beam having opposed ends and positionable in longitudinal alignment with the header, the beam having a center support which carries a generally flat second forming plate at an upper end thereof and downwardly extending second mounting brackets positioned at opposite sides of the second to forming plate for releaseably holding said deck panels; a connector for extending along and releaseably joining the center support of the header with the center support of the beam; and a post coupled with said header for supporting said header and said at least one beam at a preselected height. Notably, the connector eliminates the need for the cross member and second screw used in conventional drop head assemblies, thereby providing weight and cost savings and facilitating the ease with which the apparatus may be erected and disassembled.

In another aspect, the present invention is directed to a method of pouring and supporting the concrete deck using the apparatus described above. In the method, a form for receiving and supporting poured concrete is prepared by: joining at least one beam to a header in longitudinal alignment using a connector releaseably connected to center supports of the beam and the header; supporting the header and beam on a post at a preselected height; and releaseably joining at least one deck panel to the joined beam and header. A layer of concrete is then poured on an upper surface of the deck panel and an upper surface of said header while the deck panel is joined with said beam and header. After the concrete has hardened to a preselected strength, the deck panels are removed from the joined beam and header and the beam is then removed from the header by disconnecting the connecter from the center supports of the beam and header. The post and header are then left in place to support the hardened layer of concrete for a preselected period of time after the beam has been removed. The post and header can then be removed and reused.

BRIEF DESCRIPTION OF THE DRAWINGS

In the accompanying drawings which form part of the specification and in which like reference numerals are used to indicate like parts in the various views.

DESCRIPTION OF THE PREFERRED EMBODIMENTS

Figure 1:
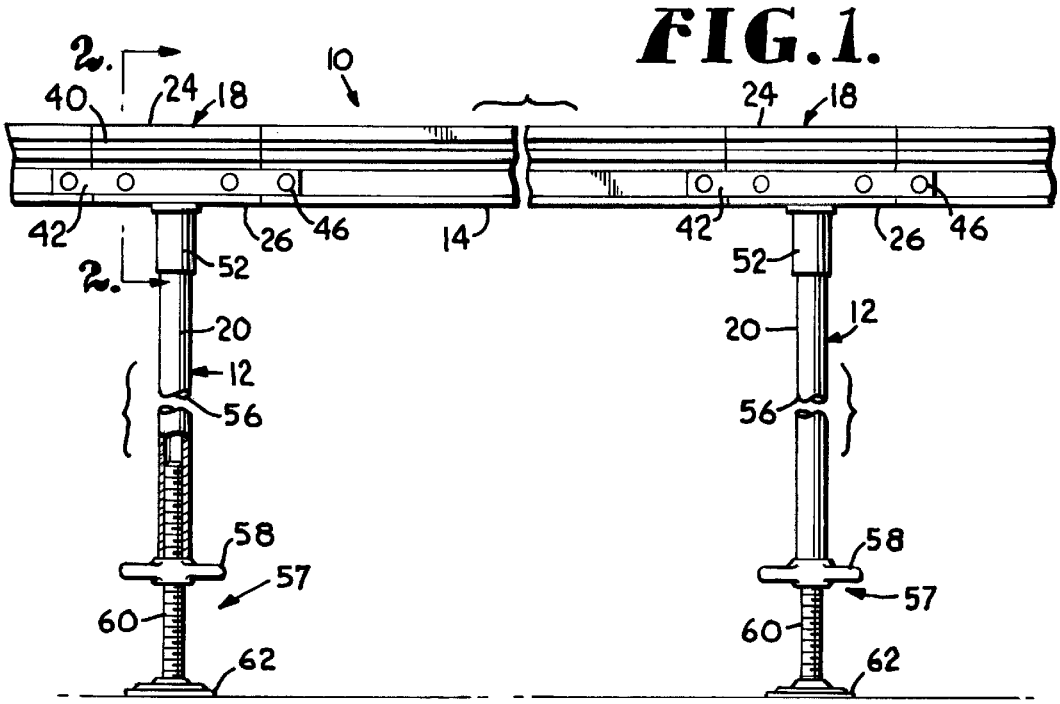
FIG. 1 is a fragmentary side elevation view of a deck forming system of the present invention used in forming poured concrete decks.
Figure 2:
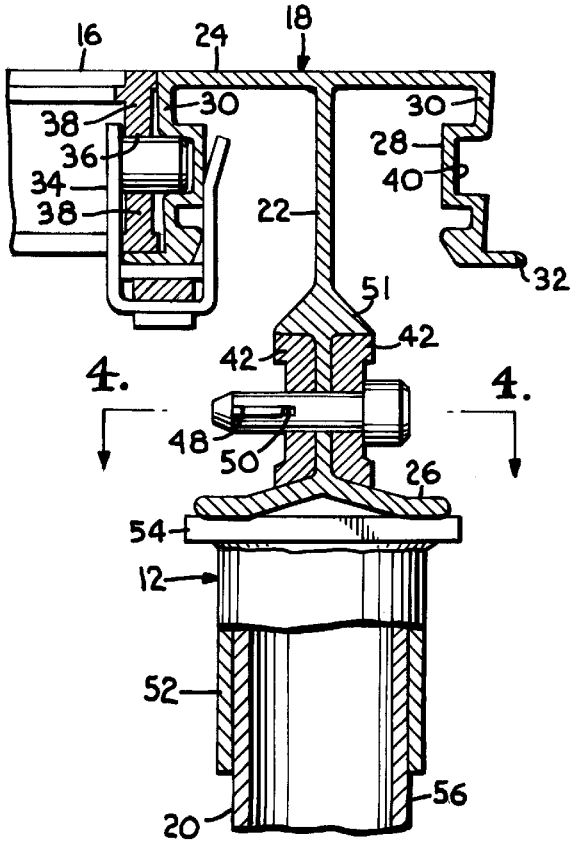
FIG. 2 is a fragmentary end elevation view of the jack post assembly and deck panels of the deck forming system shown in FIG. 1 taken in vertical section along line 2—2 in the direction of the arrows.
Figure 3:
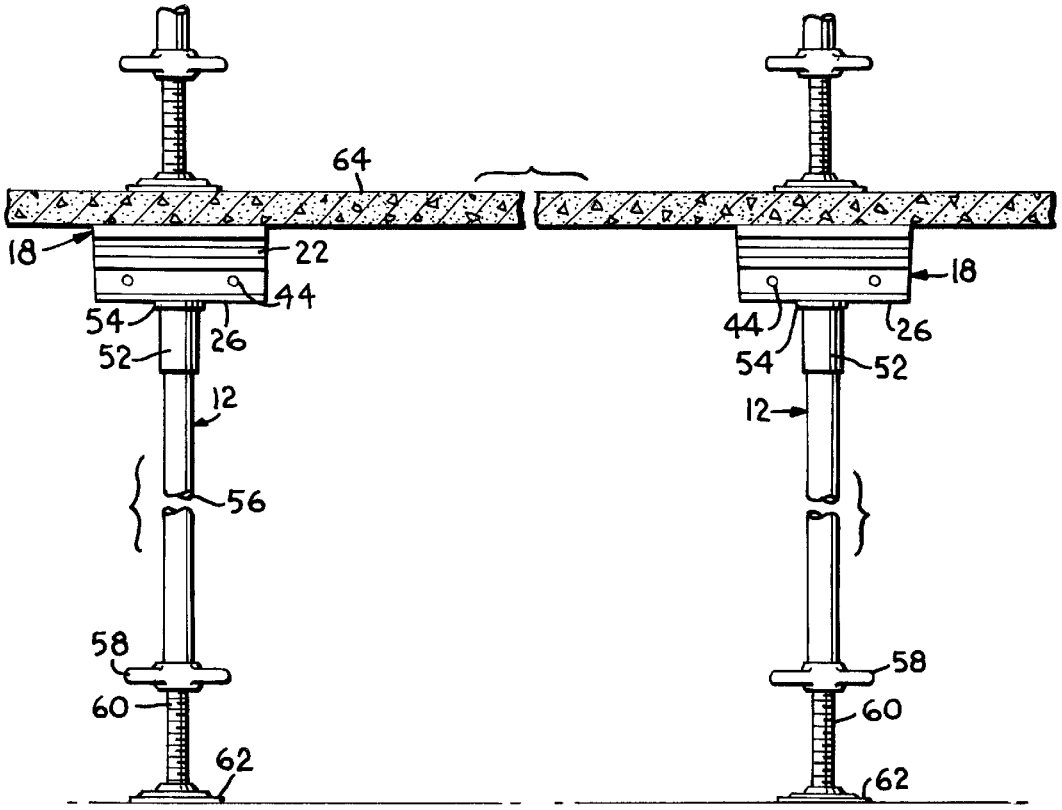
FIG. 3 is a fragmentary side elevation view similar to that shown in FIG. 1 but showing the jack post assemblies after the concrete deck has been poured and the deck beams have been removed.
Figure 4:
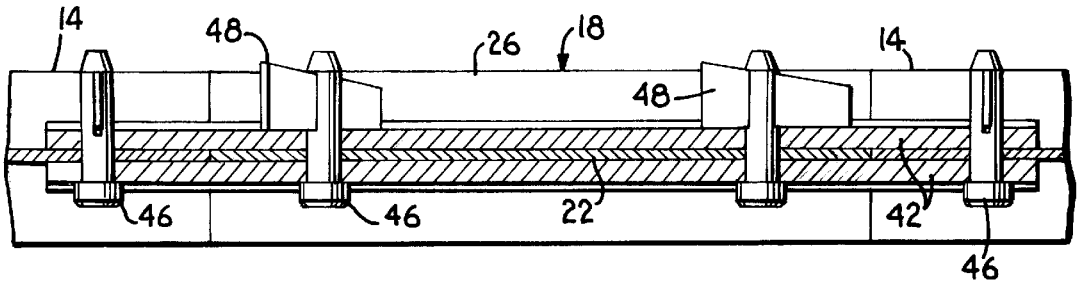
FIG. 4 is a fragmentary top plan view of the jack post header and deck beams taken in horizontal section along line 4—4 of FIG. 2 in the direction of the arrows.
Figure 5:
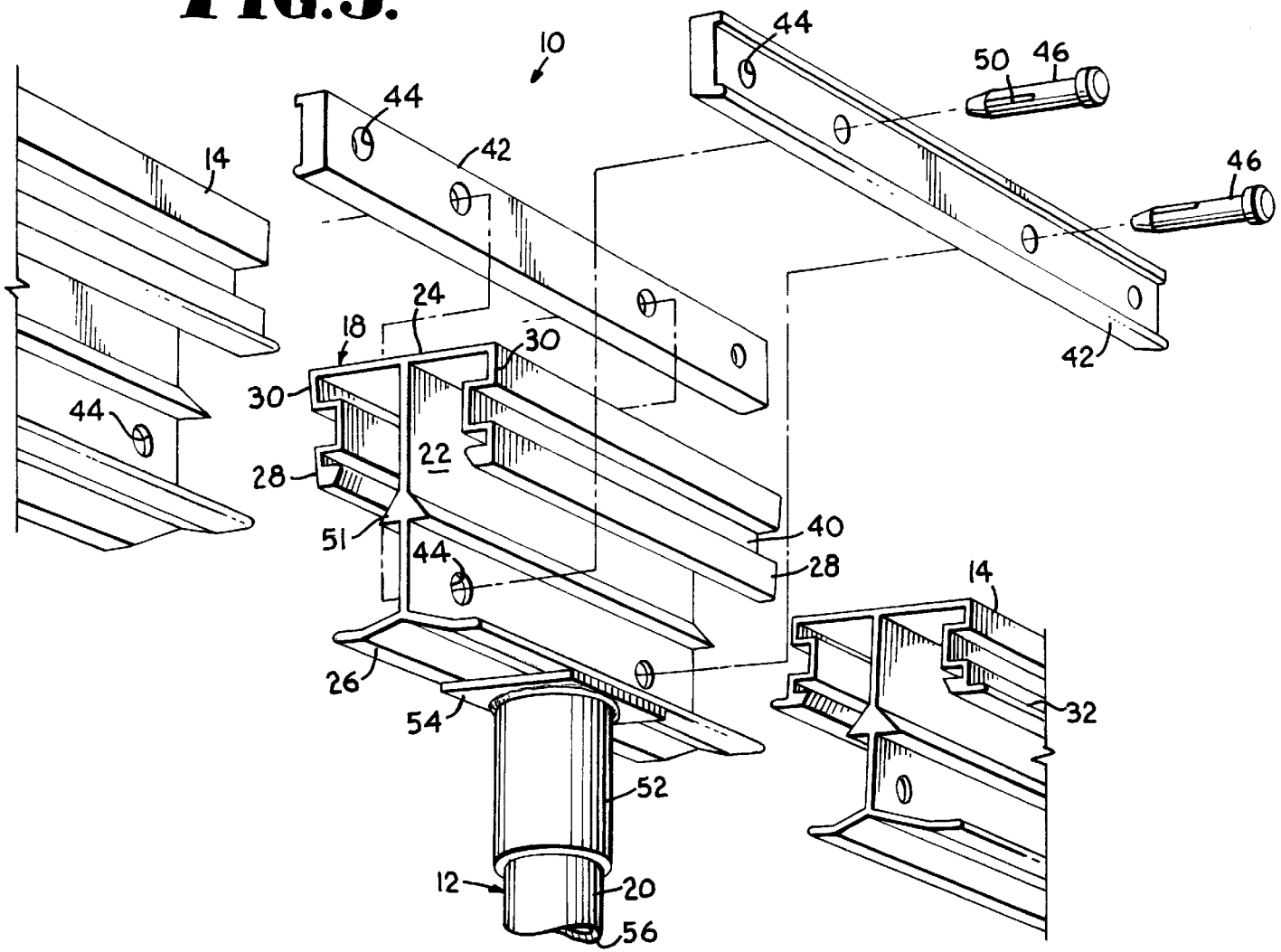
FIG. 5 is an exploded view illustrating the components of the jack post assembly and deck beams of the present invention.

Referring now to the drawings in greater detail, a deck forming system of the present invention is represented broadly by the numeral 10 and comprises a jack post assembly 12 interconnected with a plurality of deck beams 14 to provide support to a plurality of deck panels 16 (FIG. 2).

The jack post assembly 12 includes a beam-like header 18 which is supported by a jack post 20. The header 18 and the deck beams 14 preferably have substantially the same cross-sectional configuration. The following description of the header 18 construction also generally applies to the deck beams 14. The header 18 has roughly an I-beam cross section with an upright center support 22 which carries a horizontally disposed flat forming plate 24 at its upper end and a generally horizontal base plate 26 at its lower end. The upper surface of the forming plate 24 constitutes part of the form onto which concrete is poured during pouring of the deck surface and preferably has a smooth surface that will release from the poured concrete after it has hardened.

The opposed sides of the forming plate 24 each carries a downwardly and slightly inwardly extending mounting bracket 28 onto which the deck panels 16 can be releaseably secured. The mounting brackets 28 can be of any desired configuration suitable for being joined with the deck panels. In the illustrated embodiment, each mounting bracket 28 has a downwardly extending flange 30 that is approximately the same length as the thickness of the deck panels 16. A support lip 32 is present only on the deck beams 14 and extends outwardly at the lower end of the flange 30 to provide a support surface on which the deck panels 16 are positioned. The support lip 32 is preferably omitted from the header 18 to enable the deck panels 16 to be removed while the header 18 remains in place. Suitable fasteners such as deck slide clamps 34 extend through openings 36 in side rails 38 of the deck panels 16 and are releaseably secured to the mounting brackets 28. To enable use of the conventional deck slide clamps 34 and eliminate the need for mounting holes to be positioned in the flange 30, a continuous horizontal slot 40 is formed in the outer face of the flange 30. It will be appreciated that it is also within the scope of the invention to use other means, such as aligned mounting holes and pin and wedge fasteners, to releaseably join the deck panels 16 to the deck beams 14 and header 18. When the deck panels 16 are positioned on the support lip 32 and secured to the brackets 28 using slide clamps 34, the upper surface of the deck panels are aligned with the upper surface of the forming plate 24 and beams 14 to provide a smooth continuous surface on which the concrete deck is poured.

The center support 22 of the header 18 is releaseably joined at one, and preferably both, ends to deck beams 14 using a suitable connector, such as a pair of elongated flat bars 42. The bars 42 are positioned on opposed faces of the center support and are of a length to extend beyond both ends of the center support 22 and overlap a preselected distance on opposed faces of the center support of the longitudinally aligned deck beams 14. The bars 42 include a series of mounting holes 44 that align with similar mounting holes 44 in the center support 22 and the end portions of the deck beams 14. Pins 46 extend through the aligned mounting holes 44 and are secured in place by wedges 48 that extend through longitudinal slots 50 formed in the pins 46. Other types of removable fasteners can be used if desired. When the deck beams 14 are joined to the center support 22 of header 18 by the flat bars 42 and pins 46 and wedges 48, the upper surfaces of header 18 and the deck beams 14 are in maintained in coplanar and normally horizontal alignment. Although both flat bars 42 will preferably be used to join the header 18 with the deck beams 14, it will be appreciated that only a single flat bar 42 can be used if desired. In addition, one or both flat bars 42 may be made up of two shorter pieces placed end to end if desired. The shorter flat bars may be desirable in those applications where only a single deck beam 14 is being joined to the header 18. To prevent vertical shifting of the bars 42 once they have been attached to the center supports 22, an upper stop 51 extends along the opposed faces of the center supports a preselected distance from the base plate 26 so that the bars 42 are snugly received between the lower surface of the stop 51 and the upper surface of the base plate 26.

To facilitate removal of the deck beams 14 from the header 18, the ends of the header 18 are tapered toward each other in the downward direction at an angle of approximately 3 degrees to the vertical. The ends of the deck beams 14 taper in the opposite direction so that they fit snugly against the header 18 but can be easily dropped downwardly during removal. A similar inward taper is provided for the mounting brackets 28 to facilitate placement and removal of the deck panels 16.

The header 18 includes a downward facing cylindrical pocket 52 which is joined to the base plate 26 by a mounting plate 54. The pocket 52 is sized to closely receive the upper end of the jack post 20 which is simply inserted into the open end of the pocket 52.

The jack post 20 is formed of an elongated cylindrical post 56 having a preselected length depending upon the desired height of the concrete deck. The lower end of the post 56 is supported on a screw jack assembly 57 which includes an adjusting nut 58 threaded onto an upstanding screw 60. The screw 60 extends upwardly within the post 56 and the height of the jack post can be adjusted by simply turning the adjusting nut 58. A flat foot 62 can be welded or otherwise secured to the bottom end of the screw 60 to provide a stable base for the jack post 20.

The forming plate 24, center support 22 and base plate 26 are preferably integrally formed as a one-piece construction or, alternatively, can be formed separately and joined together by welding or other suitable techniques. The material selected for the components of the jack post assembly 12 will typically be one or more metals, such as aluminum, but some or all it can also be selected from various polymeric or composite materials.

In use, the deck forming system 10 is erected by longitudinally aligning the deck beams 14 at the ends of the jack post header 18. The flat bars 42 are then secured with pins 46 and wedges 48 to the center support 22 of the header 18 and the center support at the end portions of the deck beams 14. The jack posts 20 are then extended to the desired length by turning the adjusting nut 58 to extend or reduce the length of the jack posts. The upper end of each jack post 20 is then inserted into the receiving pocket 52 on the underside of the associated header 18, preferably while the header 18 and deck beams 14 are on the ground. The header 18 and beams 14 can then be raised by pivoting the jack post 20 upright. The rest of the support grid can be erected in a similar fashion and joined together, followed by placement of the deck panels 16 to complete the deck forming system 10.

After the concrete has been poured to form deck 64 and has hardened to a sufficient extent, the deck panels 16 can be removed from the deck beams 14 by removing the deck slide clamps 34. The deck beams 14 can then be removed from the header 18 by removing the pins 46 and wedges 48 holding the flat bars 42 in place. The deck beams 14 can then be dropped from the header 18 while the jack post 20 and header 18 remain in place supporting concrete deck 64. Another deck can be formed and poured on an upper level by erecting the deck forming system 10 on the already poured deck 64. This process can be repeated as many times as needed, with the jack posts 20 remaining in place until the concrete decks have developed the necessary structural strength. The jack posts 20 can then be removed by turning the adjusting nut 58 to shorten the length of the posts 20.

Notably, because only a single screw 60 is needed for the jack post assembly 12, the jack post 20 can be lighter and less expensive than the double screw jack posts conventionally used. Further weight savings are achieved by eliminating the need for the cross member conventionally used to support the deck beams. The use of flat bars 42 to secure the deck beams 14 to the header 18 facilitates assembly of the deck forming system 10 by eliminating the need to turn a second screw to align the top surface of the deck beams 14 with the header 16. Disassembly is likewise facilitated by the flat bars 42 because there is no second screw which must be turned to lower the beams to provide the clearance needed to lift the beams off the retaining pins as in convention systems. Instead, the wedges 48 are simply removed from the pins 46 to permit removal of the flat bars 42. The beams 14 are then dropped from the header 18, with the tapered ends of the beams and header reducing the opportunity for wedging or binding of the beams.

From the foregoing it will be seen that this invention is one well adapted to attain all ends and objects hereinabove set forth together with the other advantages which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. An apparatus for use in forming and supporting a poured concrete deck comprising:

a header having opposed ends and a center support which carries a generally flat first forming plate at an upper end thereof, said header further comprising downwardly extending first mounting brackets positioned at opposite sides of the forming plate and spaced from said center support for releaseably holding deck panels on which the concrete deck is poured;

an extendable post supporting said header; and means for removably connecting said center support of the header with at least one beam longitudinally aligned with said header at one of said opposed ends.

2. An apparatus for use in forming and supporting a poured concrete deck comprising:

a header having opposed ends and a center support which carries a generally flat first forming plate at an upper end thereof, said header further comprising downwardly extending first mounting brackets positioned at opposite sides of the forming plate and spaced from said center support for releaseably holding deck panels on which the concrete deck is poured;

at least one beam having opposed ends and positionable in longitudinal alignment with the header, said beam having a center support which carries a generally flat second forming plate at an upper end thereof and downwardly extending second mounting brackets positioned at opposite sides of the second forming plate and spaced from said center support for releaseably holding said deck panels;

a connector for extending along and releaseably joining the center support of the header with the center support of the beam; and a post coupled with said header for supporting said header and said at least one beam at a preselected height.

3. The invention of claim 2, wherein said connector comprises an elongated bar having holes through which removable fasteners extend for joining the connector to the center support of the header and the center support of the beam, wherein said connector can be removed from said center supports by removing said fasteners to thereby allow the beam to be disconnected from the header.

4. The invention of claim 3, including holes in the center supports of the beam and header aligned with the holes in the elongated bar for receiving said fasteners.

5. The invention of claim 4, wherein said fasteners are pin and wedge fasteners.

6. The invention of claim 3, including an outwardly extending lip at a lower end of the second mounting brackets for supporting said deck panels.

7. The invention of claim 3, wherein one end of the header abuts one end of the beam and wherein said abutting ends are inclined toward the header in the downward direction at a preselected angle to the vertical.

8. The invention of claim 7, wherein said preselected angle is approximately 3 degrees.

9. The invention of claim 7, wherein said first and second mounting brackets include a slot for receiving a deck slide clamp to releaseably join said deck panels to said first and second mounting brackets.

10. The apparatus of claim 2, wherein said post is longitudinally extendable.

* * * * *